US009410400B2

(12) United States Patent
Hallundbæk

(10) Patent No.: US 9,410,400 B2
(45) Date of Patent: Aug. 9, 2016

(54) DOWNHOLE COMPLETION

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 430 days.

(21) Appl. No.: 13/994,908

(22) PCT Filed: Dec. 16, 2011

(86) PCT No.: PCT/EP2011/073101

§ 371 (c)(1),
(2), (4) Date: Jun. 17, 2013

(87) PCT Pub. No.: WO2012/080487

PCT Pub. Date: Jun. 21, 2012

(65) Prior Publication Data

US 2013/0264063 A1 Oct. 10, 2013

(30) Foreign Application Priority Data

Dec. 17, 2010 (EP) ..... 10195577

(51) Int. Cl.
*E21B 34/14* (2006.01)
*E21B 21/10* (2006.01)
*E21B 34/00* (2006.01)

(52) U.S. Cl.
CPC ..... *E21B 34/14* (2013.01); *E21B 21/103* (2013.01); *E21B 2034/007* (2013.01)

(58) Field of Classification Search
CPC ..... E21B 34/14; E21B 2034/007
USPC ..... 166/332.1, 334.4; 251/344
See application file for complete search history.

(56) References Cited

U.S. PATENT DOCUMENTS

| | | | | |
|---|---|---|---|---|
| 3,907,046 | A * | 9/1975 | Gaylord | E21B 34/14 175/235 |
| 4,066,128 | A | 1/1978 | Davis et al. | |
| 4,310,050 | A | 1/1982 | Bourgoyne | |
| 4,427,070 | A | 1/1984 | O'Brien | |
| 5,263,683 | A | 11/1993 | Wong | |
| 2008/0000697 | A1 | 1/2008 | Rytlewski | |
| 2008/0156496 | A1 | 7/2008 | East | |
| 2009/0044944 | A1 | 2/2009 | Murray et al. | |
| 2011/0259595 | A1 | 10/2011 | Nguy et al. | |
| 2011/0284240 | A1 * | 11/2011 | Chen | E21B 23/00 166/373 |
| 2013/0168099 | A1 * | 7/2013 | Themig | E21B 34/103 166/308.1 |

FOREIGN PATENT DOCUMENTS

| | | |
|---|---|---|
| CN | 201007196 Y | 1/2008 |
| WO | WO 2009/029437 A1 | 3/2009 |
| WO | WO 2010/089728 | 8/2010 |
| WO | WO 2012/037645 A1 | 3/2012 |

OTHER PUBLICATIONS

International Search Report for PCT/EP2011/073101 mailed Feb. 10, 2012.
Examination Report issued in corresponding Australian Patent Application No. 2011343205 dated Sep. 8, 2014.

* cited by examiner

*Primary Examiner* — Jennifer H Gay
*Assistant Examiner* — George Gray
(74) *Attorney, Agent, or Firm* — Nixon & Vanderhye P.C.

(57) ABSTRACT

A downhole completion includes a production casing and a sliding sleeve assembly connected as part of the production casing. The completion includes a tubular part and a tubular sleeve.

9 Claims, 4 Drawing Sheets

DOWNHOLE COMPLETION

This application is the U.S. national phase of International Application No. PCT/EP2011/073101 filed 16 Dec. 2011 which designated the U.S. and claims priority to EP 10195577.1 filed 17 Dec. 2010, the entire contents of each of which are hereby incorporated by reference.

FIELD OF THE INVENTION

The present invention relates to a downhole completion comprising a production casing and a sliding sleeve assembly connected as part of a production casing, comprising a tubular part and a tubular sleeve.

BACKGROUND ART

In a casing downhole, it is often necessary to pressurise the interior of the casing, or parts of it, during completion or operation of the well.

The interior is pressurised to expand one or more components in predetermined positions along the casing string. These components may be expandable annular barriers, rock anchors, etc.

Common for these components is that a high pressure is necessary to expand them. The high pressure may influence on other components and in severe circumstances in fact damage these components.

Therefore, these components are protected by for instance sliding elements which are adapted to be positioned in front of the components. However, since the components to be expanded require higher and higher pressure to obtain expansion, the sealing properties of the sliding elements are not sufficient to secure that the other components are not damaged.

SUMMARY OF THE INVENTION

It is an object of the present invention to wholly or partly overcome the above disadvantages and drawbacks of the prior art. More specifically, it is an object to provide an improved downhole completion comprising a sliding sleeve assembly which is adapted to protect and seal an opening in a tubular section and/or a component inserted in the opening, even during high interior pressurising.

The above objects, together with numerous other objects, advantages, and features, which will become evident from the below description, are accomplished by a solution in accordance with the present invention by a downhole completion, comprising

- a production casing, and
- a sliding sleeve assembly connected as part of a production casing, comprising:
  - a tubular part forming part of the production casing and having a recess, an inner face, an opening and an axial extension, and
  - a tubular sleeve slidable within the recess and having an outer face and being slidable in the axial extension along the inner face between a first position, wherein fluid is allowed to flow through the opening, and a second position, wherein the fluid is hindered from flowing through the opening, wherein a sealing element is arranged in connection with the sleeve at its outer face.

In an embodiment, the opening may have a width in the axial extension and the sealing element may have a width which is larger than the width of the opening.

Furthermore, the tubular sleeve may have at least one circumferential groove arranged at its outer face.

Moreover, the sealing element may be arranged in the groove.

In addition, the sleeve may have at least two circumferential grooves, each groove comprising a sealing element.

Also, the tubular part may have a recess in which the sleeve slides.

In an embodiment, the opening may have a width in the axial extension and the sealing elements may be arranged with an axial distance which is larger than the width of the opening.

Moreover, the sealing element may be a chevron seal or an O-ring.

Additionally, the sleeve may have an inner face comprising indentations.

Furthermore, the opening may comprise a valve, such as an inflow control valve, a flow restriction, a throttle or similar restriction.

Also, the tubular part may have threads for connecting the tubular part with other tubular parts to form a casing.

The invention furthermore relates to use of the downhole completion described above in connection with a casing string in a borehole.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
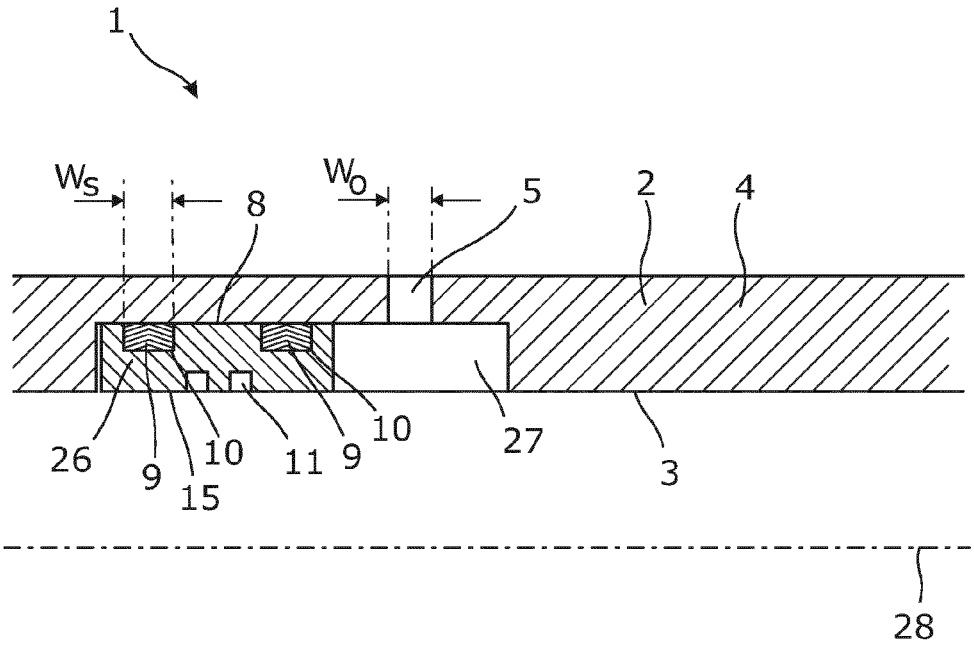
FIG. 1 shows a sliding sleeve assembly connected as part of a casing in its first and open position.

FIG. 1 shows a partial view of a downhole completion 100 of a sliding sleeve assembly 1 connected as part of a production casing 4. The sliding sleeve assembly 1 comprises a tubular part 2 having an inner face 3, an opening 5 and an axial extension 28. The tubular part 2 is connectable with other tubular parts to form a production casing or casing string. The connection between the tubular part 2 and the production casing 4 is most often a threaded connection. The sliding sleeve assembly 1 further comprises a tubular sliding sleeve 26 having an outer face 8 and being slidable in the axial extension 28 along the inner face 3 of the tubular part. In FIG. 1, the sliding sleeve assembly 1 is shown in a first position, wherein fluid is allowed to flow through the opening 5, and in FIG. 2, the sliding sleeve assembly 1 is shown in a second position, wherein the fluid is hindered from flowing through the opening. The sliding sleeve assembly 1 further comprises a sealing element 9 arranged in connection with the sleeve in circumferential grooves 10 at the outer face 8 of the tubular sleeve 26.

By having a sliding sleeve 26 in a production casing of a completion 100 or system 100, a production section producing water can be closed off. Furthermore, such sliding sleeve can be used to protect a completion component 50 (shown in FIGS. 4-6) pressurising a casing in order to expand e.g. an annular barrier. Not all components 50 can withstand the high pressure required to expand annular barriers, and thus it may be necessary to seal off these components 50 when making the completion and subsequently open them in order to use the functionality of the component 50.

The sliding sleeve slides in a recess in the tubular part 2 so that the sleeve 26 does not limit the space within the casing, and thus a sliding sleeve in a recess 27 does not decrease the overall inner diameter of the tubular part 2 and thus of the casing 4. When making the completion, it is very important that the inner diameter is not reduced unnecessarily as further components or tubulars are to pass the already installed casing 4.

As can been seen in FIG. 1, the opening 5 has a width $w_o$ in the axial extension of the tubular part 2, and the sealing element 9 has a width $w_s$ which is larger than the width of the opening. The width $w_s$ of the sealing element 9 being larger than the width $w_o$ of the opening 5 ensures that the sealing element does not get stuck when the sliding sleeve assembly 1 passes the opening 5. If the sealing element 9 is smaller than the width $w_o$ of the opening, the sealing element may get stuck at an edge of the opening 5 and be pulled up and squeezed between the outer face 8 of the tubular sleeve 26 and the inner face of a recess 27. In this situation, the sealing element 9 is no longer able to seal off the opening 5.

The sliding sleeve 26 has an inner face 15 comprising indentations 11 for moving the sleeve in the recess by means of a key tool extending into the indentations and forcing the sleeve 26 to slide axially along the inner face of the recess 27.

Figure 2:
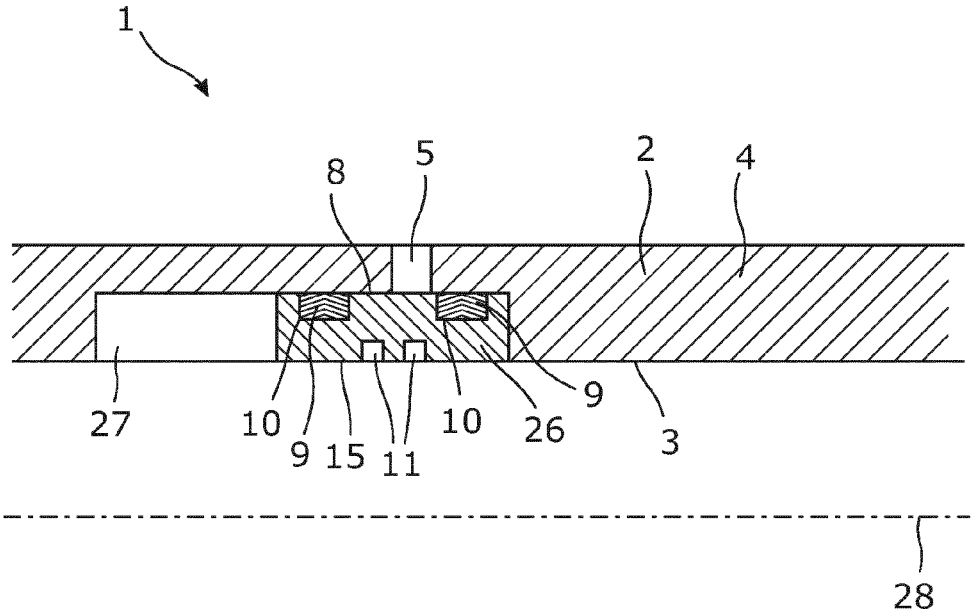
FIG. 2 shows the sliding sleeve assembly of FIG. 1 in its second and closed position.

In FIGS. 1 and 2, the sealing elements 9 are arranged with an axial distance between them which is larger than the width $w_o$ of the opening 5 so that the sealing elements 9 in the second position is arranged on opposite sides of the opening 5, thereby sealing the opening 5.

Figure 3:
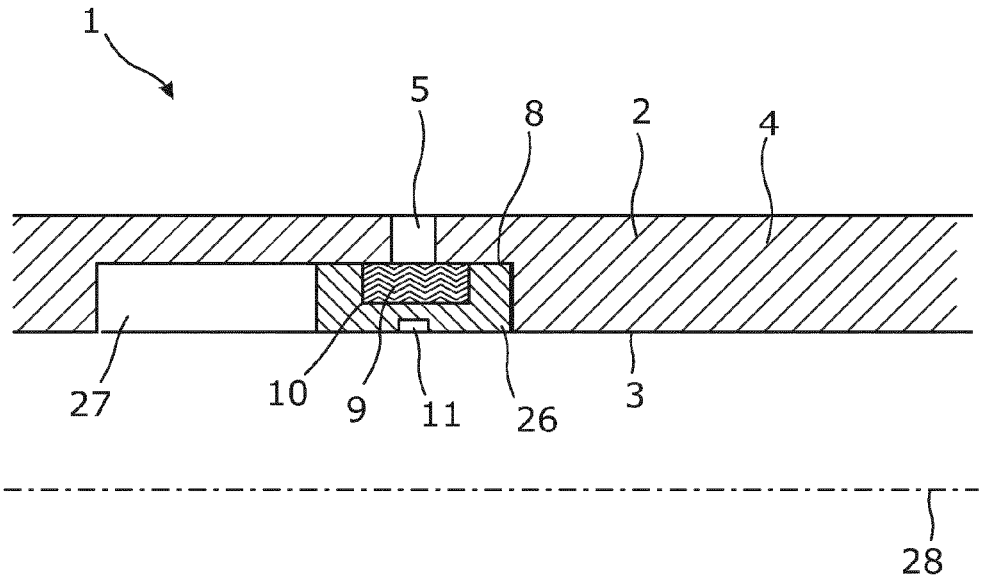
FIG. 3 shows another embodiment of the sliding sleeve assembly.

In FIG. 3, the sliding sleeve assembly 1 comprises one sealing element 9 and one indentation 11. The sliding sleeve assembly 1 is shown in its closed and second position. The width $w_s$ of the sealing element 9 is more than twice the width $w_o$ of the opening 5, meaning that the sealing element 9 covers the opening 5 and part of the inner face of the recess 27 surrounding the opening 5 in order to seal the opening.

Figure 4:
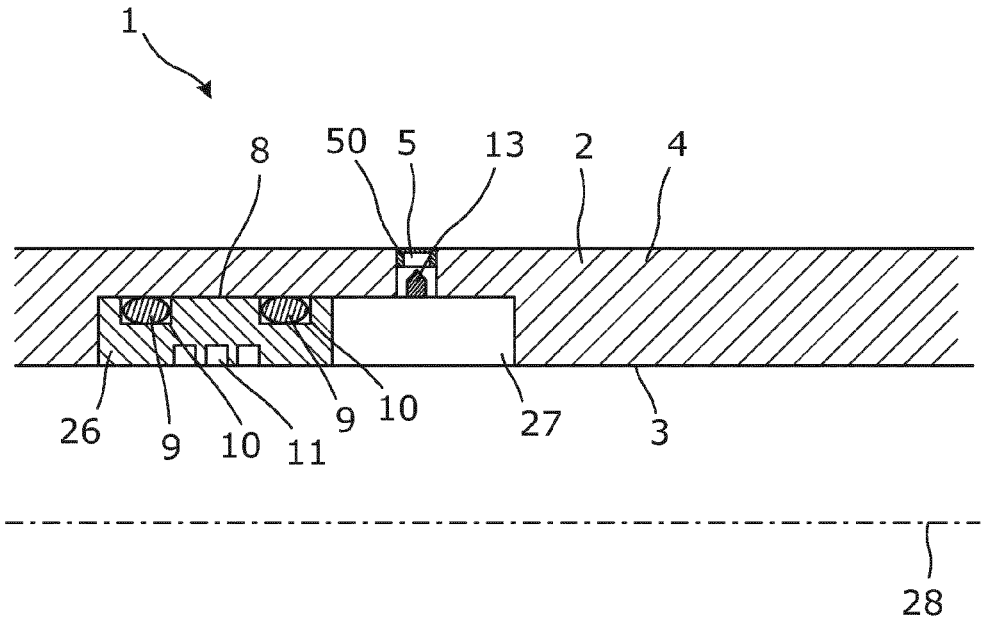
FIG. 4 shows another embodiment of the sliding sleeve assembly.

The sealing element 9 is a chevron seal in FIGS. 1-3 and an O-ring in FIG. 4. The chevron seals have V-shaped parts, the tips of which point towards the outer face 8 of the sliding sleeve 26 or in the opposite direction. In FIG. 4, the opening 5 comprises a completion component 50, such as a valve 13, such as an inflow control valve, a flow restriction, a throttle or similar restriction. The sliding sleeve assembly 1 is shown in its first and open position, in which fluid may flow from the surrounding annulus or formation into the interior of the tubular part 2.

Figure 5:
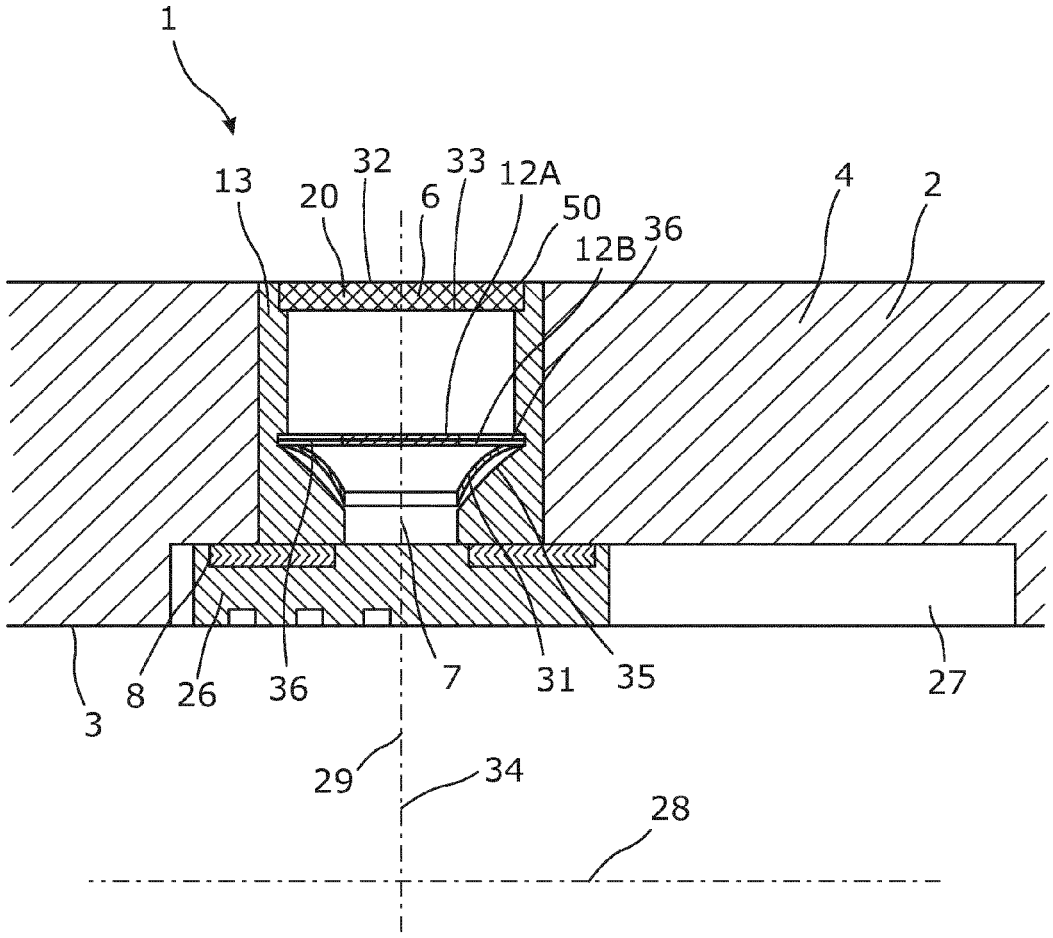
FIG. 5 shows yet another embodiment of the sliding sleeve assembly.

The sliding sleeve assembly 1 of FIG. 5 is shown in its second and closed position, in which fluid from the surrounding annulus or formation is hindered from entering into an interior of the production casing 4. When the sleeve is moved to its open position, the fluid may enter from the formation into the interior of the tubular part 2 through the valve 13. The V-shaped parts of the chevron seal point in a direction perpendicular to the direction shown in FIGS. 1-3 and thus point in a direction along the axial extension.

The sliding sleeve 26 is shown in its closed position, in which fluid from the valve 13 is prevented from flowing into the production casing 4, but also preventing the fluid in the production casing from escaping through the inflow control valve. The sliding sleeves 26 are arranged opposite the valves 13 and are slidable from an open position to a closed position, causing the sleeves 26 to slide back and forth in recesses 27 in the wall of the production casing 4 and form part of the wall thickness.

Having a slidable sleeve 26 opposite a valve 13 as part of a casing wall allows for closing of the sliding sleeve 26 when the production casing 4 is pressurised from within to perform an operation requiring highly pressurised fluid, such as when expanding annular barriers. When the operation requiring high pressure is finalised, the sliding sleeve 26 can be opened, and fluid from the annulus is able to flow into the production casing 4 through the valve 13.

Having a sleeve sliding in a recess in the production casing 4 ensures that the inner diameter of the production casing is not decreased, which is advantageous as such a decrease may limit subsequent operations in the well.

In FIG. 5, the sliding sleeve assembly 1 comprises an inflow control valve, such as a constant flow valve. In order to control the flow, the valve comprises a spring element 12A, 12B. The spring element 12A, 12B is springy along the axial direction of the valve perpendicular to the axial extension of the production casing for providing a spring force. The housing has a seat 35 and a membrane 31, and the spring element is a diaphragm moving towards the seat to close any valve openings 36 in the valve 13. The spring element 12A, 12B comprises two spring plates, each formed as a star, arranged one on top of the other and displaced in relation to each other so that the tips of the star-shaped plates 12A, 12B form openings there between. When the pressurised fluid from a reservoir flows in through a screen 20 in the inlet, the fluid forces the star-shaped plates 12A, 12B down towards the seat 35 and the membrane 31, thereby minimising the passage through the openings. The membrane 31 has an aperture in its centre through which the fluid passes before entering the outlet 7 and after passing the openings.

The tubular part 2 of the sliding sleeve assembly 1 has fastening means for being fastened to the production casing 4 and thereby form part of a production casing string. The fastening means may be threads for creating a threaded connection with the rest of the production casing 4.

Figure 6:
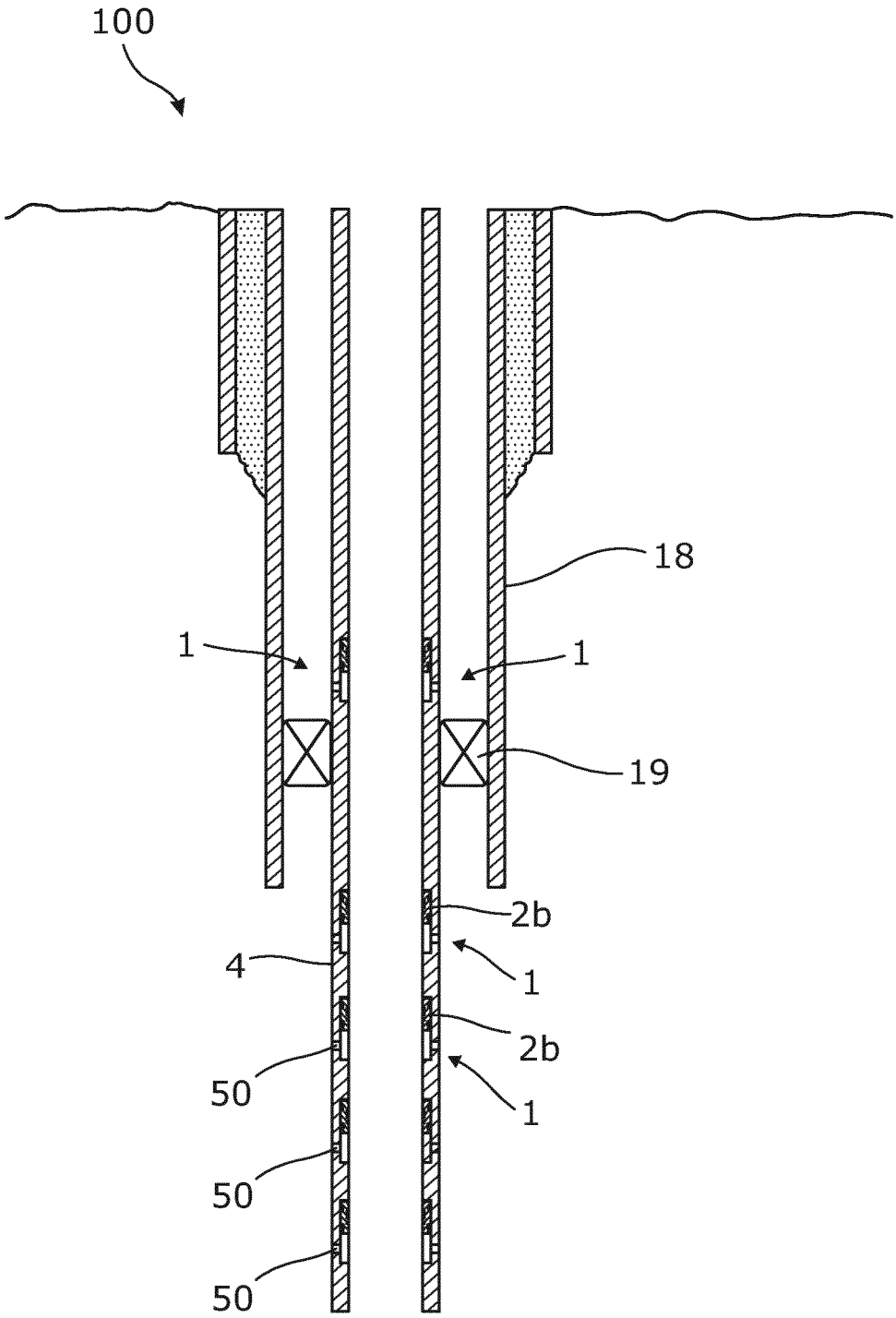
FIG. 6 shows a downhole system according to the invention.

FIG. 6 shows a downhole system 100 comprising a casing string or production casing 4 and at least one sliding sleeve assembly 1 connected with the casing string 4. The downhole system 100 comprises several sliding sleeve assemblies 1 along the casing string, also called the production casing. In this way, the entry of fluid from the formation can be controlled by opening and closing the sliding sleeves. Furthermore, the casing can be pressurised from within by closing the sliding sleeve assemblies 1 when performing an operation requiring high pressurised fluid to expand expandable sleeves of annular barriers or a fixation device, such as a rock anchor.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a production casing is meant any kind of pipe, tubing, tubular, liner, string etc. used downhole in relation to oil or natural gas production and thus the production casing is the casing in which the hydro carbons, such as oil and/or gas, flow in order to bring up oil and/or gas from the reservoir. The production casing may comprise a surface casing and a hanging casing. The sliding sleeve is used to seal off or expose an opening through which the oil and/or gas or water from the formation/reservoir could flow through, and thus closing the sleeve seals off the opening so that oil and/or gas and/or water can no longer flow into the production casing.

Although the invention has been described in the above in connection with preferred embodiments of the invention, it will be evident for a person skilled in the art that several modifications are conceivable without departing from the invention as defined by the following claims.

The invention claimed is:

1. A downhole completion, comprising a production casing, and a sliding sleeve assembly connected as part of the production casing, comprising:

a tubular part forming part of the production casing and having a recess, an inner face, an opening and an axial extension, a tubular sleeve slidable within the recess and having an outer face and being slidable in the axial extension along the inner face between a first position, wherein fluid is allowed to flow through the opening, and a second position, wherein the fluid flows through the opening to a lesser extent than in the first position, the sleeve being repeatably slidable between the first and second positions, wherein, in the first and second positions, an inner face of the sleeve has a diameter along the entire axial extent of the inner face that is no less than a diameter of the inner face of the tubular part, wherein the tubular sleeve has at least first and second circumferential grooves at the outer face, the first groove comprising a first sealing element and the second groove comprising a second sealing element, wherein the opening has a width (wo) in the axial extension and each sealing element has a width ($w_s$) which is larger than the width (wo) of the opening, wherein the sealing elements are arranged with an axial distance along the axial extension which is larger than the width of the opening such that when one sleeve is in the second position, the first sealing element engages a first surface of the recess adjacent a first side of the opening and the second sealing element engages a second surface of the recess adjacent a second side of the opening, and wherein when the sleeve is in the first position, fluid may be permitted to flow between the tubular part and the opening via the recess, without passing through the sleeve.

2. A downhole completion according to claim 1, wherein the sealing element is a chevron seal or an O-ring.

3. A downhole completion according to claim 1, wherein the inner face of the sleeve comprises indentations.

4. A downhole completion according to claim 1, wherein the opening comprises a valve.

5. A downhole completion according to claim 4, wherein the valve comprises an inflow control valve.

6. A downhole completion according to claim 1, wherein the sleeve is repeatably movable from the first position to the second position, and from the second positon to the first position.

7. A downhole completion according to claim 1, wherein the inner face of the sleeve includes a central portion with one more or more indentations to receive a tool for moving the sleeve between the first and second positions.

8. A downhole completion according to claim 7, wherein the one or more indentations on the inner face of the sleeve are positioned between the first and second sealing elements on the outer face of the sleeve.

9. A downhole completion according to claim 1, wherein the inner face of the sleeve is substantially flush with the inner face of the tubular part in the first and second positions.

* * * * *